United States Patent [19]

Oakes

[11] 4,308,000

[45] Dec. 29, 1981

[54] DISCHARGE OUTLET COUPLING AND GUIDERAIL ASSEMBLY FOR SUBMERSIBLE PUMPS

[75] Inventor: William J. Oakes, Greencastle, Pa.

[73] Assignee: Edison International, Inc., Rolling Meadows, Ill.

[21] Appl. No.: 123,373

[22] Filed: Feb. 21, 1980

[51] Int. Cl.[3] ..... F04B 39/14

[52] U.S. Cl. ..... 417/360; 285/24

[58] Field of Search ..... 417/360; 285/24; 222/385

[56] References Cited

U.S. PATENT DOCUMENTS

| | | | |
|---|---|---|---|
| 3,136,259 | 6/1964 | Bood | 417/360 |
| 3,427,982 | 2/1969 | Englesson | 417/360 |
| 3,659,964 | 5/1972 | Dahlgren | 417/360 |
| 3,743,447 | 7/1973 | Lynch | 417/360 |
| 3,880,553 | 4/1975 | Wolford | 417/360 |

*Primary Examiner*—Richard E. Gluck

*Attorney, Agent, or Firm*—Jon Carl Gealow; Ronald J. LaPorte; William H. Wendell

[57] ABSTRACT

A discharge outlet coupling and guiderail assembly for a submersible pump has at least two spaced guiderails to which the submersible pump is slidably connected by means of a rail mounting bracket so that the submersible pump is movable up and down the guiderails parallel to the longitudinal axis thereof to permit the discharge outlet of the pump disposed remote from the guiderail mounting brackets to be oriented and aligned for engagement and disengagement with the flanged inlet end of a discharge elbow in the discharge line of the associated fluid pumping system to which the submersible pump must be operatively connected. Orientation of the pump, the respective spaced guiderails, and the discharge elbow is controlled by means of a common base plate to which the respective guiderails and the discharge elbow are connected in predetermined spaced relation. The discharge outlet of the pump has spaced hook connectors which engage the flanged inlet end of the discharge elbow when the pump is lowered for initial engagement with the discharge elbow. Adjustable sleeves on the respective spaced guiderails insure that the pump will be level in the operating and connected position and a cam assembly moves the pump laterally towards the face of the flanged inlet end of the discharge elbow as the pump is moved into operating position. A suitable seal which deflects or moves under discharge pressure of the fluid being pumped will prevent leakage through the joint formed at the connection of the discharge outlet of the pump to the flanged inlet end of the discharge elbow.

10 Claims, 9 Drawing Figures

DISCHARGE OUTLET COUPLING AND GUIDERAIL ASSEMBLY FOR SUBMERSIBLE PUMPS

BACKGROUND OF THE INVENTION

This invention relates generally to wet pit pumping systems and more particularly to a discharge outlet coupling and guiderail assembly for submersible pumps used in such pumping systems.

Wet pit pumping systems and apparatus for such pumping systems are well known in the pumping art particularly for the pumping of waste water and for sewerage with entrained solids.

The pumping systems used in these applications must be so constructed that the submerged pumps must be removable for maintenance and repair. Therefore, the pumping systems must make a provision for connecting and disconnecting the submersible pumps from the associated discharge elbows or discharge lines for the wet pit pumping systems.

The prior art shows various devices for meeting and overcoming this problem as is shown in U.S. Pat. Nos. 3,880,553; 3,810,718; 3,771,914; 3,427,982; and 3,018,925.

The present invention provides an improved means for overcoming this problem by providing a discharge outlet coupling and guiderail assembly for the submersible pump in such systems which permits the pump to be guided in a vertical axis to bring the discharge outlet end of the submerisble pump into interconnecting relationship with the flanged inlet end of the discharge line for the associated wet pit pumping system so as to insure that parallelism of the joint between the adjacent faces of the pump discharge outlet and the flanged inlet end of the discharge line and that the pump will be level in the assembled position.

This is accomplished in the present invention by fixing the guiderails and the discharge elbow of a discharge line in predetermined spaced relation and providing means to interconnect the discharge of the pump to the flanged inlet end of the discharge elbow so that the joint therebetween can be sealed by a simple annular axially slidable seal member movable to the sealed position by the pressure exerted by the fluid being discharged from the discharge outlet of the submersible pump.

SUMMARY OF THE INVENTION

Thus, the present invention covers a discharge outlet coupling and guiderail assembly for submersible pumps including, a base plate means, a discharge means for delivering pumped fluid connected to said base plate means having, a flanged inlet end, guiderail means connected to said base plate a predetermined spaced distance from said flanged inlet end on the discharge means, the submersible pump having, an inlet, a discharge outlet, and a rear mounting bracket connected to the submersible pump to mount said submersible pump for sliding movement along the guiderail means, coupling means connected to the discharge outlet of said submersible pump including, spaced hook means disposed for engagement with the flanged inlet end of said discharge means when said submersible pump is lowered on said guiderail means, adjustable means on said guiderail means for establishing and maintaining the submersible pump level in the assembled operating position on the said flanged inlet end, seal means for sealing the joint formed between said flanged inlet end and the coupling means, and means for raising and lowering said submersible pump on the guiderail means for relative engagement and disengagement of the flanged inlet end of said discharge means.

Additionally the discharge outlet coupling and guiderail assembly for submerisble pumps as above described including, means on the guiderail means and/or said adjustable means for shifting said submersible pump so as to bring the discharge outlet thereof into closer proximity with the flanged inlet end of the discharge means as the submersible pump is moved into assembled position therewith.

Accordingly, it is an object of the present invention to provide a discharge outlet coupling and guiderail assembly for a submersible pump which will raise and lower the pump in a substantially vertical plane for engagement and disengagement of the associated discharge means for the pumping system in which the submersible pump is connected.

It is another object of the present invention to provide an improved discharge outlet coupling and guiderail assembly for a submersible pump which includes an adjustment means to allow for horizontal alignment of the pump casing with the flanged inlet end of the discharge means for the associated pump system.

It is another object of the present invention to provide an improved discharge outlet coupling and guiderail assembly for a submersible pump wherein the adjustment means can be used to correct misalignments that may develop due to warpage or bending of the base plate or other changes in the elements of the associate piping system or the pit to which the submersible pump and guide rail assembly are connected.

It is another object of the present invention to provide an improved discharge outlet coupling and guiderail assembly for a submersible pump wherein means is provided to move the submersible pump laterally as it moves into assembled position so as to reduce the clearance between the discharge outlet of the pump and the face of the flanged inlet end of the discharge means for the associated pumping system.

It is another object of the present invention to provide an improved discharge outlet coupling and guiderail assembly for a submersible pump to guide the submersible pump into an assembled operating position so as to provide a relatively simple means for sealing the discharge outlet of the submersible pump to the associated discharge means of the pumping system in which the submersible pump is being utilized.

It is another object of the present invention to provide a base plate assembly for supporting the guiderail assembly and the inlet end of the discharge line of the associated piping system to which the submersible pump is detachably connected adaptable for use with a variety of different sized submersible pumps.

Other objects and advantages of the invention will become apparent from the following detailed description of a preferred embodiment made with reference to the accompanying drawings wherein:

BRIEF DESCRIPTION OF THE DRAWINGS

Referring to the drawings, FIG. 1 shows a wet pit pumping system or installation having a submersible pump therein utilizing the improved discharge outlet coupling and guiderail assembly in accordance with the present invention.

Figure 1:
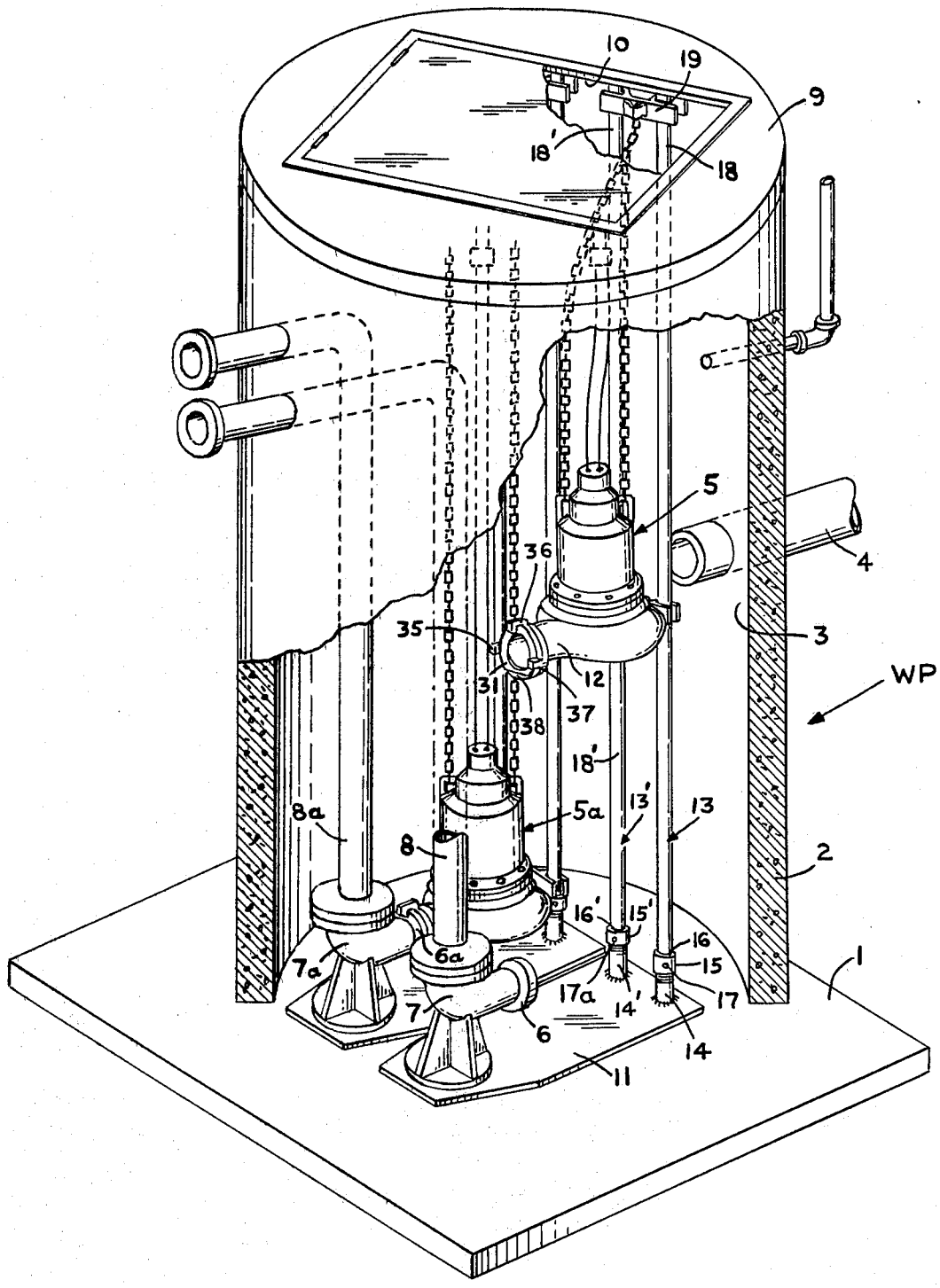
FIG. 1 is a side elevational view partly broken away in vertical section showing a wet pit or basin with a submersible pumping system therein having submersible pumps embodying the invention.

The wet pit pumping system or installation generally designated WP generally includes a fixed base 1 and a generally cylindrical casing 2 mounted thereon which defines a well or collecting chamber 3 therewith for collecting waste water, sewage with entrained solids or other fluid materials to be pumped which enter the well or collecting space 3 through an inlet pipe 4. In the well or chamber 3 in the illustrated wet pit pumping system, there will be one or more submersible pumps as at 5 and 5*a* which are slidable for engagement with the flanged inlet ends 6 and 6*a* of the discharge elbows 7 and 7*a*, in turn connected to discharge pipes 8 and 8*a* so that fluid discharged by the submersible pumps 5 and 5*a* can be transferred from the well or chamber 3 to the discharge lines 8 and 8*a* for the system or installation.

The well or chamber 3 is provided with one end top member as at 9 having an access opening 10 which permits access to the chamber or well 3 for raising and lowering the submersible pumps 5 and 5*a* for maintenance and repair as may be required in connection with the operation of the wet pit pumping system.

Since wet pit pumping systems are well known in the art, they are not more fully described herein other than to show the interrelation between the submersible pumps 5 and 5*a* and the fluid flow conducting elements or piping members such as the discharge elbows 7 and 7*a* and the discharge lines 8 and 8*a* connected thereto. Further, FIG. 1 shows that the submersible pumps must have suitable guiding means and coupling means to permit these pumps to be brought into operative engagement and connection with the discharge means for the wet pit pumping system. The improved discharge outlet coupling and guiderail assembly for the submersible pumps illustrated in the preferred embodiment of the present invention, will now be described with respect to the submersible pump 5. It will be understood that submersible pump 5*a* will have the same improved discharge outlet coupling and guiderail assembly hereinafter described for submersible pump 5.

DISCHARGE OUTLET CONNECTION AND GUIDERAIL ASSEMBLY

Figure 2:
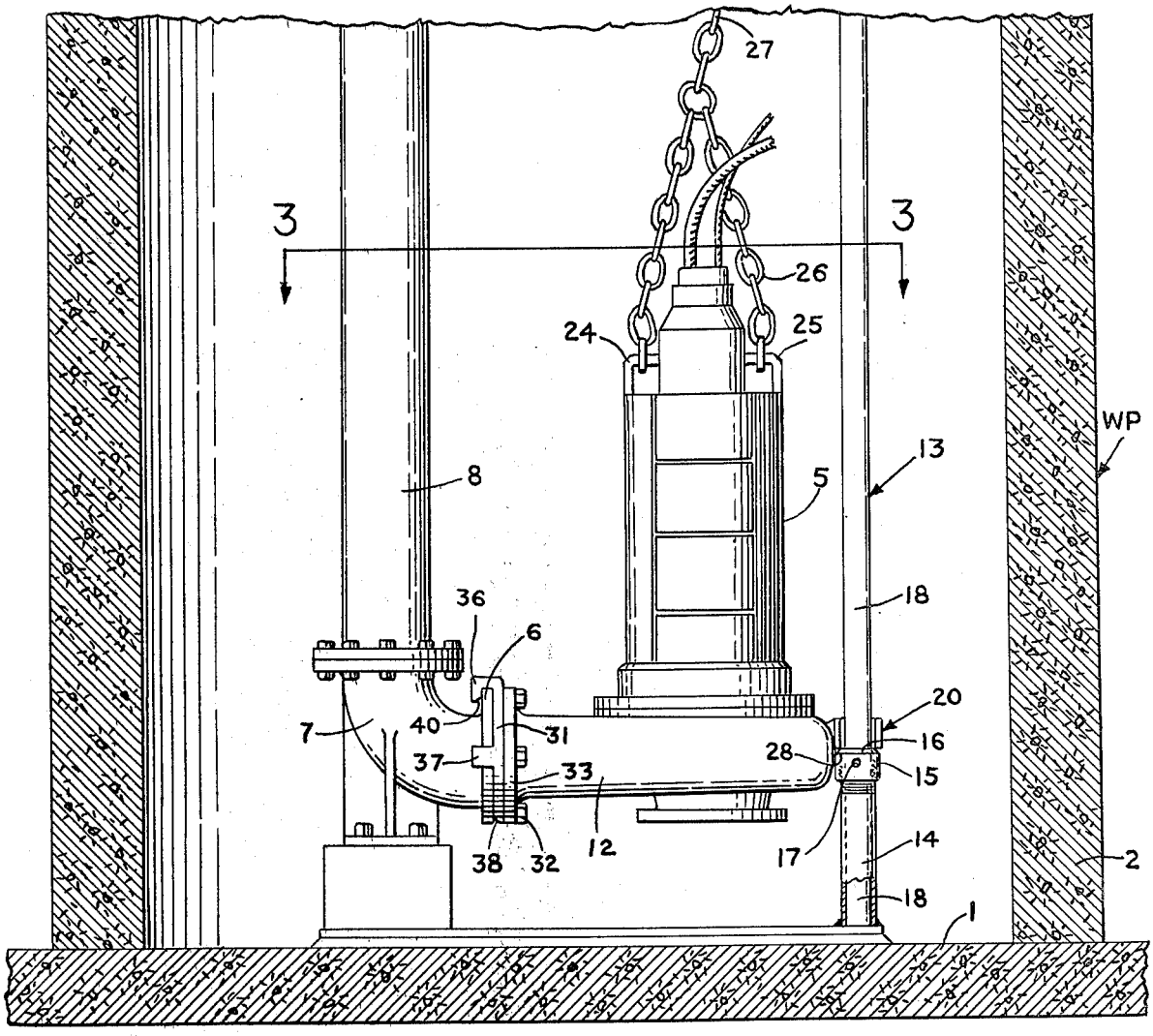
FIG. 2 is a side view of one of the submersible pumps of the submersible pumping systems shown in FIG. 1.

FIGS. 1 and 2 show that in order to establish proper orientation for operative connection of the submersible pump 5 to the flanged inlet end 6 of the discharge elbow 7, the discharge elbow 7 is connected to a base plate 11 by any suitable means such as welding at one end thereof such that the flanged inlet end 6 will be positioned adjacent the discharge outlet 12 of the submersible pump 5 when the same is lowered for operative connection thereto as is hereinafter described. At the end or side of the base plate 11 a predetermined spaced distance from the point of connection or flanged inlet end 6 for the discharge elbow 7 at least two guiderail assemblies generally designated 13 and 13′ will be connected by any suitable means to the base plate 11 as hereinafter described.

The guiderail assemblies 13 and 13′ are elongated vertically disposed generally parallel members which extend in the vertical axis of the wet pit pump system WP. Each of the guiderail assemblies 13 and 13′ includes a guiderail support as at 14 and 14′, one end of which is affixed to the base plate 11 as by welding or any other suitable means and the opposite end of which is threaded to permit an adjusting collar as at 15 and 15′ to be threadably mounted thereon to permit the upper cammed face 16 and 16′ to be adjustably positioned so as to provide means for leveling the submersible pump 5 in assembled position as is also hereinafter, described. A setscrew in each of the respective adjusting collars, as at 17 and 17′, is provided to hold the adjusting collars 15 and 15′ at the desired adjusted position for the particular submersible pump installation.

At their lower ends, the elongated guiderails 18 and 18′ extend through the adjustable collars 15 and 15′ into the guiderail support 14 and 14′ and are connected to a guiderail bracket 19 at their upper end so as to maintain each of the respective guiderail assemblies in fixed position relative to each other and to the discharge elbow 7. Thus, as the submersible pump is moved up and down on the guiderails, it can be positioned on downward movement for engagement with the flanged inlet end 6 of the discharge elbow 7 and disengaged from the flanged inlet end 6 on upward movement of the submersible pump.

Figure 3:
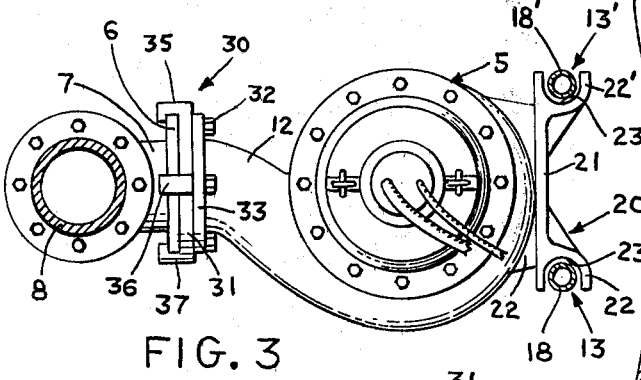
FIG. 3 is a top view of the submersible pump taken on line 3—3 of FIG. 2.
Figure 5:
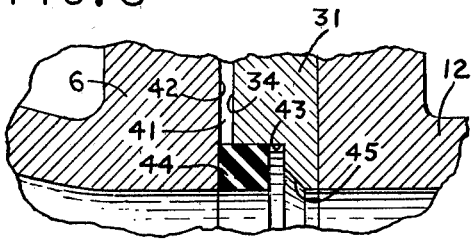
FIG. 5 is an enlarged view of a fragment of the slidable seal shown in FIG. 4 of the drawings.

In order to move the submersible pump 5 upwardly and downwardly on the guiderail assemblies, a guiderail mounting bracket 20 is connected to the casing of the submersible pump 5 on the side thereof remote from the discharge outlet as is clearly shown in FIGS. 1, 2 and 3 of the drawings.

The guiderail mounting bracket 20 has a central elongated support section 21 for connecting this rail mounting bracket to the pump 5. At the respective opposite ends of the central elongated support section 21, spaced semi-circular guiderail flanges are provided as at 22 and 22′ which open in opposite directions so that the bracket 20 can be assembled position, be disposed between the spaced guiderail assemblies 13 and 13′ so as to bring the guiderail recesses 23 and 23′ into operative sliding association about the respective guiderails 18 and 18′ of the guiderail assemblies 13 and 13′ as is shown in FIG. 3 of the drawings.

When in assembled position on said guiderail 18 and 18′ as above described, the submersible pump 5 can be moved upwardly and downwardly by any suitable means. As shown in FIGS. 1 and 2 for the wet pit pump installation illustrated herein, the submersible pump is provided with spaced connecting lugs as at 24 and 25 to which a chain 26 is connected so that a cable 27 in turn connected and centered on the chain 26 can be utilized to raise and lower the submersible pump 5 along the guiderail 18 and 18'. Hoists for moving submersible pumps into and out of the pit or chamber of a wet pit pumping installation are well known as will be understood by those skilled in the art and, accordingly, this device is not more fully described herein.

FIGS. 2, 6, 7, 8 and 9 show further that the guiderail flanges 22 and 22' are provided with cam follower surfaces as at 28 and 28' formed on the front sections of the respective guiderail flanges 22 and 22'. The cam follower surfaces 28 and 28' coact with the cam surfaces 16 and 16' on the adjustment collars 15 and 15' to provide a secondary generally lateral movement of the submersible pump 5 as it forms the joint with the flanged inlet end 6 of the discharge elbow 7 on the discharge line 8. This secondary lateral adjustment of the submersible pump 5 acts to reduce the gap at the joint between the adjacent faces of the flanged inlet end 6 of the discharge elbow and the discharge outlet 12 of the submersible pump to enhance operation of a slidable seal therebetween, as will be clear from the description of the discharge outlet coupling means which will now follow.

DISCHARGE OUTLET COUPLING MEANS

When the submersible pump 5 is lowered on the guiderail assemblies 13 and 13' as above described, a suitable discharge outlet coupling means generally designated 30 is provided to connect the discharge outlet 12 of the submersible pump 5 to the flanged inlet end 6 of the discharge elbow 7 in the discharge line of the wet pit pump installation WP.

The discharge outlet coupling means 30 includes connecting flange 31 which is connected as by threaded means 32 to flange 33 on the end of the discharge outlet 12 of the submersible pump 5.

Connecting flange 31 is a generally flat annular member with a flat outer face or surface as at 34. On the outer periphery or outer annulus of the connecting flange 31, a plurality of forwardly extending spaced hook members as at 35, 36 and 37 are formed as is clearly shown in FIGS. 1, 2, 3, 4 and 6 of the drawings.

FIGS. 1, 2, 3, 4 and 6 further show that two of the hook members as at 35 and 37 are disposed on diametrically opposite sides of the connecting flange 31 in substantially the same horizontal plane while the hook member 36 lies in the vertical plane midway between the two side hooks 35 and 37 but at the uppermost portion of the connecting flange 31.

Figure 4:
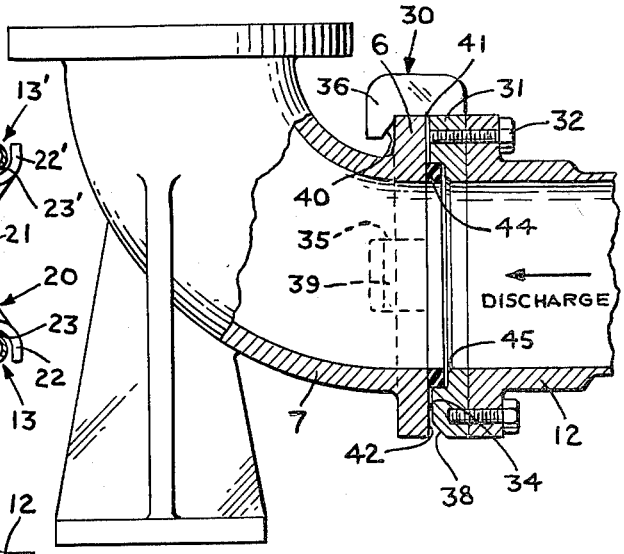
FIG. 4 is a side view in vertical section of the slidable seal between the discharge outlet for the submersible pump and the flange inlet end of the discharge elbow as shown in FIG. 2 of the drawings.
Figure 6:
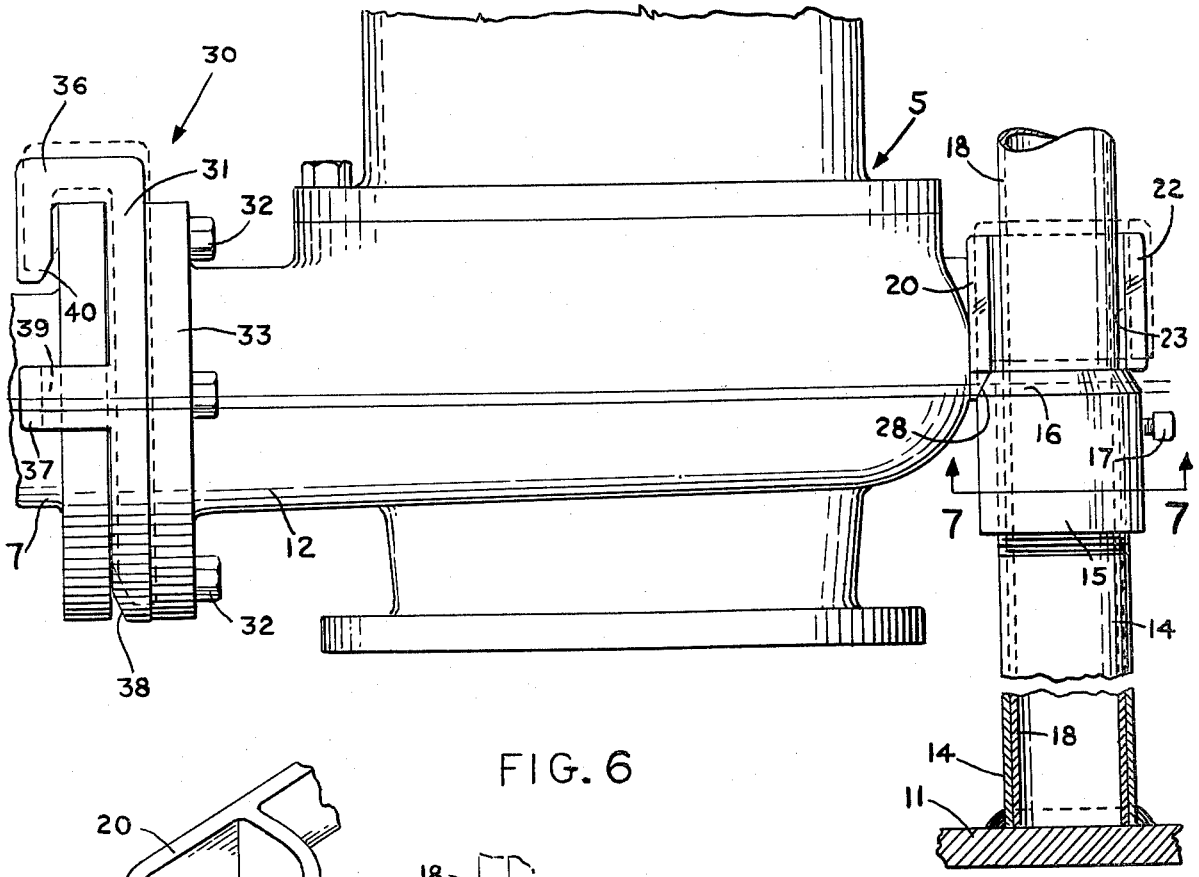
FIG. 6 is a side view in vertical section of the interrelation between the rail mounting bracket for the submersible pump shown in FIG. 2 and the adjustable collar on the guiderail pipes for guiding the submersible pump shown in FIG. 2 into assembled position in the pumping system.
Figure 8:
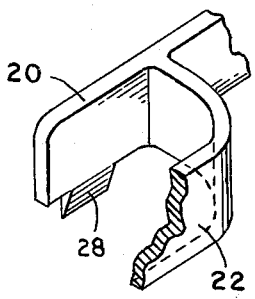
FIG. 8 is a perspective view of one guiderail flange on the guiderail mounting bracket broken away to show the cam follower surface formed on the front section thereof.
Figure 9:
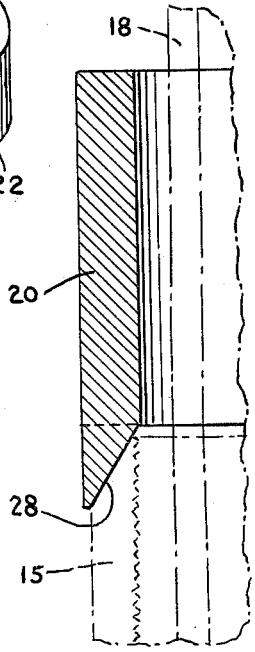
FIG. 9 is a fragmentary vertical section taken at line 9—9 of FIG. 7 showing the interrelation between the guiderail flange cam follower surface and the cam surfaces on the adjustable collar.
Figure 7:
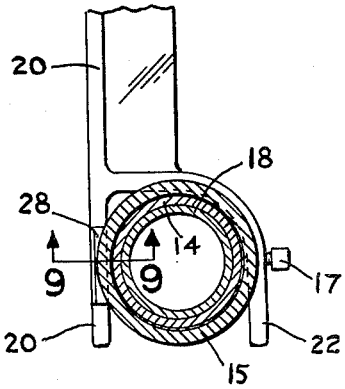
FIG. 7 is a cross section taken on line 7—7 of FIG. 6 on one of the guiderails.

Further, FIGS. 2, 4 and 6 show that the connecting flange 31 is provided with a first cam surface as at 38 at the lowermost point thereof opposite from the medially disposed hook member 36, second spaced cam surfaces as at 39 on the two side hooks 35 and 37 and a third cam surface 40 on the inner portion of the hook member 36.

When the submersible pump 5 is lowered on the guiderail assemblies 13 and 13', the lower edge or cam surface 38 on the connecting flange 31, the second cam surfaces on side hooks 35 and 37 and the third cam surface 40 on the centrally disposed hook member 36 compensate for any looseness between the rail mounting flanges 22 and 22' and the guiderails 18 and 18' so as to guide the side hooks 35 and 37 and the center hook member 36 into engagement and abutment with the flanged inlet end 6 of the discharge elbow to form the discharge outlet coupling 30 as shown at FIGS. 1, 2, 3 and 4 of the drawings. Engagement of the flange inlet end 6 during the lowering of the submersible pump 5 to the discharge outlet coupling 30 produces a joint or gap as at 41 between the front face 34 on the connecting flange 31 and the adjacent face 42 on the flanged inlet end 6 of the discharge elbow 7. In order to seal this joint or gap, a seal member groove is cut on the inner annulus of the connecting flange 31 as at 43 in which an annular seal member as at 44 is mounted so as to permit movement thereof within the seal member groove 43 to effectively seal the joint or gap between the face 34 of the connecting flange and the face 42 of the flanged inlet end 6 of the discharge elbow 7. The seal member groove 43 is further provided with a beveled annular edge or entrance chamber as at 45.

During operation of the submersible pump 5, the differential force caused by pumped pressure acting on the larger annular area at the back face of the seal member 44 formed by the seal groove 43 and its entrance chamber 45 to move the seal member 44 laterally and thus insure that the inner seal member 44 will effectively act to maintain sealing of the gap 41.

Further, FIG. 4 shows that the seal member groove 43 and the seal member 44 mounted therein are so arranged that the seal moves beyond the front face 34 of the connecting flange 31 and therefore no metal to metal contact of faces 34 and 42 of the connecting flange 31 and flanged inlet end 6 will occur during the operation of the submersible pump 5.

As has been described, the rail mounting bracket 20 is provided with the cam follower surfaces as at 28 and 28' so that after the first fine alignment and connection of the connecting flange 31 is made with the flanged inlet end 6 to form the discharge outlet coupling 30 and then as the submersible pump is further lowered to the lowermost assembly position, the camming surfaces 28 and 28' coact with the cam surfaces 16 and 16' to make the submersible pump move laterally. This reduces the gap between the connecting flange 31 and the flanged inlet end 6 and thus moves the seal member 44 into a better position for operating to seal the joint or gap 41 between these members.

As will be understood by those skilled in the art, it is desirable and necessary that the front flange face 34 on the connecting flange 31 and the flange face 42 on the flanged inlet end 6 have substantial parallelism to each other because this insures equal compression of the entire annular face of the sealing member 44 during operation of the submersible pump 5 for better sealing of this joint or gap 41 and to mimimize seal maintenance requirements for this type of submersible pump installation.

In order to provide this desirable and necessary parallelism between the flange faces in the discharge outlet coupling 30, the adjustable threaded collars 15 and 15' located on the support pipes 14 and 14' during the initial installation of the submersible pump 5 will be adjusted so as to form with central hook member 36 an ideal three point suspension for holding these flange faces of the connecting flange 31 and the flanged inlet 6 in this desired parallelism, thus insuring proper sealing of the joint or gap 41 in the discharge outlet coupling means 30.

To remove the pump, upward force exerted on the hoist cable 27 is transmitted to the chain hoist 26 and the lugs 24 and 25. Since the chain hoist is centered, the rail mounting bracket 20 will slide upwardly along the guiderails 18 and 18' and the connecting flange 31 having a loose fit will slip off the flanged inlet end 6 of the discharge elbow 7.

Thus an improved discharge outlet coupling and guiderail assembly has been described for guiding a submersible pumping unit into an appropriate assembly and operationing position to ideally seal the discharge outlet of the submersible pump to the discharge line of the associated pumping system in which the submersible pump is being utilized and for removing the submersible pumping unit for maintenance and repair.

Further, inherent in the base plate assembly and the improved discharge outlet coupling and guiderail assembly is the fact that the base plate assembly can be adapted for use with a wide variety of submersible pumps merely by adjusting the size of the base plate and the predetermined distance between the fixed guiderail supports 14 and 14' and the inlet flange 6 on the fixed discharge elbow 7 of the associated piping system to which the pump is connected.

It will be understood that the invention is not to be limited to the specific construction or arrangement of parts shown but that they may be widely modified within the invention defined by the claims.

What is claimed is:

1. A discharge outlet coupling and guiderail assembly for submersible pumps;

a. base plate means b. discharge means for delivering pumped fluid connected to said base plate and including, a flanged inlet end thereon, c. guiderail means connected to said base plate a predetermined spaced distance from the flanged inlet end on the discharge means, d. said submersible pump having, an inlet, a discharge outlet, and a rail mounting bracket connected to the submersible pump to mount said submersible pump for sliding movement along said guiderail means, e. coupling means connected to the discharge outlet of said submersible pump including, spaced hook means disposed for engagement with the flanged inlet end on said discharge means when said submersible pump is lowered on said guiderail means, f. adjustable means on said guiderail means for establishing and maintaining the submersible pump level in the assembled operating position on the said flanged inlet end, g. seal means for sealing the joint formed between said flanged inlet end and the coupling means, and h. means for raising and lowering said submersible pump on the guiderail means for relative engagement and disengagement of the flanged inlet end of said discharge means.

2. In a discharge outlet coupling and guiderail assembly for submersible pumps as claimed in claim 1 including, means on said guiderail means operatively associated with said submersible pump for shifting said submersible pump laterally so as to bring the discharge outlet of the submersible pump in closer proximity to the flanged inlet end of the discharge means so as to reduce the joint therebetween which must be sealed.

3. In a discharge outlet coupling and guiderail assembly for submersible pumps as claimed in claim 1 wherein the rail mounting bracket for the submersible pump is on the side opposite from the coupling means.

4. A discharge outlet coupling and guiderail assembly for submersible pumps;

a. base plate means, b. discharge means for delivering pumped fluid connected to said base plate and including, a flanged inlet end therein, and a seal face on said flanged inlet means, c. guiderail means connected to said base plate a predetermined spaced distance from the flanged inlet end on the discharge means, d. said submersible pump having, an inlet, a discharge outlet, and a rail mounting bracket connected to the submersible pump to mount said submersible pump for sliding movement along said guiderail means, e. coupling means connected to the discharge outlet of said submersible pump having an outboard face thereon and including, spaced hook means disposed for engagement with the flanged inlet end on said discharge means when said submersible pump is lowered on said guiderail means, f. adjustable means on said guiderail means for establishing and maintaining the submersible pump level with respect to said flanged inlet means whereby said seal face and said outboard face are disposed substantially parallel to each other, g. seal means for sealing the joint formed between the seal face on said flanged inlet end and the outboard face on said coupling means when said submersible pump is assembled for delivering pump fluid to said discharge means, and h. means for raising and lowering said submersible pump relative said discharge means on the base plate means,

5. The discharge outlet coupling and guide assembly means as claimed in claim 4 including, means on said guiderail means operatively associated with said submersible pump for shifting said submersible pump so as to bring said seal face and said outboard face in closer proximity to each other when said coupling member is connected to said flange inlet end of the discharge means.

6. The discharge outlet coupling and guiderail assembly for submersible pumps as claimed in claim 4 wherein said spaced hook means includes, a. at least two oppositely disposed side hooks on said coupling member, b. at least one centrally disposed hook at the upper end of said coupling member and generally the vertical axis of said flanged inlet means, and c. said side hooks disposed to slide into assembled position for engagement of the flanged inlet end of the discharge means and said central hook to engage the upper end of said flanged inlet end when the coupling member is connected to the flanged inlet end of the discharge means.

7. The discharge coupling and guiderail assembly for submersible pumps as claimed in claim 6 wherein said central hook means and said adjustable means on the guiderails provide means for maintaining the submersible pump level with respect to said flanged inlet means.

8. The discharge outlet coupling and guiderail assembly for submersible pumps as claimed in claim 4 including;

a. cam surface means formed on the upper end of said adjustable means, b. cam follower means formed on said rail mounting bracket and disposed to coact and engage with the cam surfaces on said adjustable means to move said submersible pump in a lateral direction so as to reduce the gap between said seal face on the flanged inlet means and the outboard face on the coupling means.

9. In a discharge outlet coupling and guiderail assembly for submersible pumps as claimed in claim 4 wherein the said mounting brackets and the discharge outlet are disposed on opposite sides of the submersible pump.

10. A base plate assembly for submersible pumps connectible to an associated pumping system including, a. sized base plate means, b. a connecting element for the pumping system fixedly connected to said base plate means and including, a flanged inlet end thereon, c. guiderail assembly means including, a guiderail support fixedly connected to the base plate means, a predetermined spaced distance from the flanged inlet end of the connecting element, d. said guiderail assembly means also including, adjustable means for establishing and maintaining the submersible pump level in assembled operating position to the flanged inlet end of the connecting element and for moving the same so as to minimize the joint formed therebetween.

* * * * *